US009559412B2

(12) United States Patent
Erentok

(10) Patent No.: US 9,559,412 B2
(45) Date of Patent: Jan. 31, 2017

(54) WIRELESS PORTABLE ELECTRONIC DEVICE HAVING A CONDUCTIVE BODY THAT FUNCTIONS AS A RADIATOR

(71) Applicant: Nokia Technologies Oy, Espoo (FI)

(72) Inventor: Aycan Erentok, Sunnyvale, CA (US)

(73) Assignee: Nokia Technologies Oy, Espoo (FI)

( * ) Notice: Subject to any disclaimer, the term of this patent is extended or adjusted under 35 U.S.C. 154(b) by 52 days.

(21) Appl. No.: 14/714,846

(22) Filed: May 18, 2015

(65) Prior Publication Data

US 2016/0344096 A1 Nov. 24, 2016

(51) Int. Cl.

| | |
|---|---|
| ***H01Q 1/48*** | (2006.01) |
| ***H01Q 1/24*** | (2006.01) |
| *H01Q 1/42* | (2006.01) |
| *H01Q 1/40* | (2006.01) |
| *H01Q 1/38* | (2006.01) |

(52) U.S. Cl.

CPC ..... *H01Q 1/48* (2013.01); *H01Q 1/24* (2013.01); *H01Q 1/38* (2013.01); *H01Q 1/40* (2013.01); *H01Q 1/42* (2013.01)

(58) Field of Classification Search

CPC ..... H01Q 9/286; H01Q 1/38; H01Q 1/48; H01Q 1/40; H01Q 1/42

USPC ..... 343/847, 873, 846, 795, 872, 702

See application file for complete search history.

(56) References Cited

U.S. PATENT DOCUMENTS

| | | | |
|---|---|---|---|
| 8,432,321 B2 | 4/2013 | Arkko et al. | |
| 2010/0123633 A1 | 5/2010 | Ozden et al. | |
| 2012/0287013 A1* | 11/2012 | Zhang | H01Q 1/40 343/873 |
| 2013/0016016 A1 | 1/2013 | Lin et al. | |
| 2014/0302890 A1 | 10/2014 | Lai et al. | |

FOREIGN PATENT DOCUMENTS

| | | | |
|---|---|---|---|
| CN | 201585005 | U | 9/2010 |
| CN | 201805000 | U | 4/2011 |
| EP | 2 110 882 | A1 | 10/2009 |
| EP | 2 284 948 | A1 | 2/2011 |

(Continued)

OTHER PUBLICATIONS

Laird; Annual Report and Accounts 2010; pp. 1-133.

(Continued)

*Primary Examiner* — Joseph Lauture
(74) *Attorney, Agent, or Firm* — Alston & Bird LLP

(57) ABSTRACT

An apparatus, such as a wireless portable electronic device, is provided that includes a body formed of a conductive material. The body defines an internal cavity and an opening. The wireless portable electronic device also includes a ground plane disposed within the internal cavity and electromagnetically coupled to the body. The wireless portable electronic device additionally includes an antenna, such as a loop antenna or a monopole, disposed within the internal cavity and electromagnetically coupled to the body such that the body functions as a radiator. The wireless portable electronic device further includes a three-dimensional ground plane extension disposed within the internal cavity so that at least a part of the three-dimensional ground plane extension overlies the antenna. The three-dimensional ground plane extension is galvanically coupled to the ground plane and electromagnetically coupled to the body.

20 Claims, 8 Drawing Sheets

(56) References Cited

FOREIGN PATENT DOCUMENTS

WO WO 2012/069884 A1 5/2012

OTHER PUBLICATIONS

"LG and Prada debut the latest Prada Phone by LG in Europe"; Exclusive form of sophistication and style in contemporary mobility; London, UK; Nov. 18, 2008; pp. 1-9.
International Search report and Written Opinion for related Patent Cooperation Treaty Patent Application No. PCT/FI2016/050320 dated Aug. 2, 2016, 11 pages.

* cited by examiner

WIRELESS PORTABLE ELECTRONIC DEVICE HAVING A CONDUCTIVE BODY THAT FUNCTIONS AS A RADIATOR

TECHNOLOGICAL FIELD

An example embodiment relates generally to a wireless portable electronic device and, more particularly, to an apparatus, such as a wireless portable electronic device, having a body formed of a conductive material that functions as a radiator.

BACKGROUND

Wireless portable electronic devices are increasingly being designed so as to have a body, such as a housing, formed of a conductive material, such as a metal. Wireless portable electronic devices are designed to have a conductive body for various reasons including for aesthetic purposes. Many wireless portable electronic devices also include one or more antennas for communication, such as with other devices, with sensors, with a network or otherwise. The antennas are generally disposed within the body of the wireless portable electronic device. However, the conductive material that forms the body of the wireless portable electronic device may substantially impair the communications performance of the antenna. As such, the design trend toward forming the body of a wireless portable electronic device from a conductive material may be in conflict with the performance requirements of the antennas of the portable electronic device.

Additionally, at least some wireless portable electronic devices are being designed so as to have a smaller form factor, such as to have a form factor of a smartwatch. As such, the volume available within such smaller portable electronic devices for antennas is correspondingly reduced. Additionally, the extent to which an antenna may be spaced apart from the conductive body of such smaller portable electronic device is also generally limited. As such, the challenges associated with maintaining acceptable communication performance with antennas housed within such smaller portable electronic devices may be exacerbated. Further, radiation in the very close proximity of a human body may create large losses due to electromagnetic (EM) absorption, thereby also limiting communication performance.

BRIEF SUMMARY

An apparatus, such as a wireless portable electronic device, is provided in accordance with an example embodiment that has a body formed of a conductive material that houses an antenna, but that does so in such a manner that the performance of the antenna within the conductive body is enhanced. In this regard, the wireless portable electronic device of an example embodiment is configured such that the antenna is electromagnetically coupled to the body where the conductive body serves as a radiator itself. Consequently, the wireless portable electronic device of an example embodiment may transmit and/or receive signals with improved performance characteristics even though the wireless portable electronic device offers the advantages, such as in terms of aesthetics, of a body formed of a conductive material, such as a metal material, and, in some instances has a small form factor, such as, for example, the form factor of a watch.

In an example embodiment, an apparatus, such as a wireless portable electronic device, is provided that includes a body comprised of a conductive material. The body defines an internal cavity and an opening. The apparatus also includes a ground plane disposed within the internal cavity and electromagnetically coupled to the body. The apparatus additionally includes an antenna, such as a loop antenna or a monopole, disposed within the internal cavity and electromagnetically coupled to the body such that the body functions as a radiator. The apparatus further includes a three-dimensional ground plane extension disposed within the internal cavity so that at least a part of the three-dimensional ground plane extension overlies the antenna. The three-dimensional ground plane extension is galvanically coupled to the ground plane and electromagnetically coupled to the body.

The three-dimensional ground plane extension of an example embodiment includes a first portion that overlies the antenna and a second portion that extends from the first portion toward the ground plane. The three-dimensional ground plane extension of an example embodiment is positioned between the antenna and the opening defined by the body. The apparatus of an example embodiment also includes a conductive member disposed within the internal cavity and galvanically coupled to both the ground plane and the three-dimensional ground plane extension. The conductive member of this example embodiment is positioned between the ground plane and the opening defined by the body. The conductive member of this example embodiment includes a floor portion and an edge portion extending outwardly from the floor portion in a direction away from the ground plane.

In another example embodiment, an apparatus, such as a wireless portable electronic device, is provided that includes a body comprised of a conductive material. The body defines an internal cavity and an opening. The apparatus also includes a ground plane disposed within the internal cavity. The apparatus additionally includes an antenna, such as a loop antenna or a monopole, disposed within the internal cavity and electromagnetically coupled to the body such that the body functions as a radiator. The apparatus of this example embodiment further includes a three-dimensional ground plane extension disposed within the internal cavity so that at least a part of the three-dimensional ground plane extension overlies the antenna. The three-dimensional ground plane extension includes a first portion that overlies the antenna and a second portion that extends from the first portion towards the ground plane. The first portion of the three-dimensional ground plane extension is configured to serve as a mechanical support structure for another component of the apparatus.

The three-dimensional ground plane extension of an example embodiment is positioned between the antenna and the opening defined by the body. The apparatus of an example embodiment also includes a conductive member disposed within the internal cavity and galvanically coupled to both the ground plane and the three-dimensional ground plane extension. The conductive member of this example embodiment is positioned between the ground plane and the opening defined by the body. The conductive member of this example embodiment includes a floor portion and an edge portion extending outwardly from the floor portion in the direction away from the ground plane.

In a further example embodiment, an apparatus, such as a wireless portable electronic device, is provided that includes a body comprised of the conductive material. The body defines an internal cavity and an opening. The apparatus also includes the ground plane disposed within the internal cavity. The apparatus further includes an antenna, such as a loop antenna or a monopole, disposed within the internal cavity and electromagnetically coupled to the body such that the body functions as a radiator. The apparatus additionally includes a three-dimensional ground plane extension disposed within the internal cavity so that at least a part of the three-dimensional ground plane extension overlies the antenna. The apparatus further includes a conductive member disposed within the internal cavity and galvanically coupled to both the ground plane and the three-dimensional ground plane extension.

The three-dimensional ground plane extension of an example embodiment includes a first portion that overlies the antenna and a second portion that extends from the first portion towards the ground plane. The three-dimensional ground plane extension of this example embodiment is galvanically coupled to the ground plane and the first portion of the three-dimensional ground plane extension is configured to serve as a mechanical support structure for another component of the apparatus. The three-dimensional ground plane extension of an example embodiment is positioned between the antenna and the opening defined by the body. The conductive member of an example embodiment is positioned between the ground plane and the opening defined by the body. The conductive member of an example embodiment includes a floor portion and an edge portion extending outwardly from the floor portion in a direction away from the ground plane.

BRIEF DESCRIPTION OF THE DRAWINGS

Figure 1:
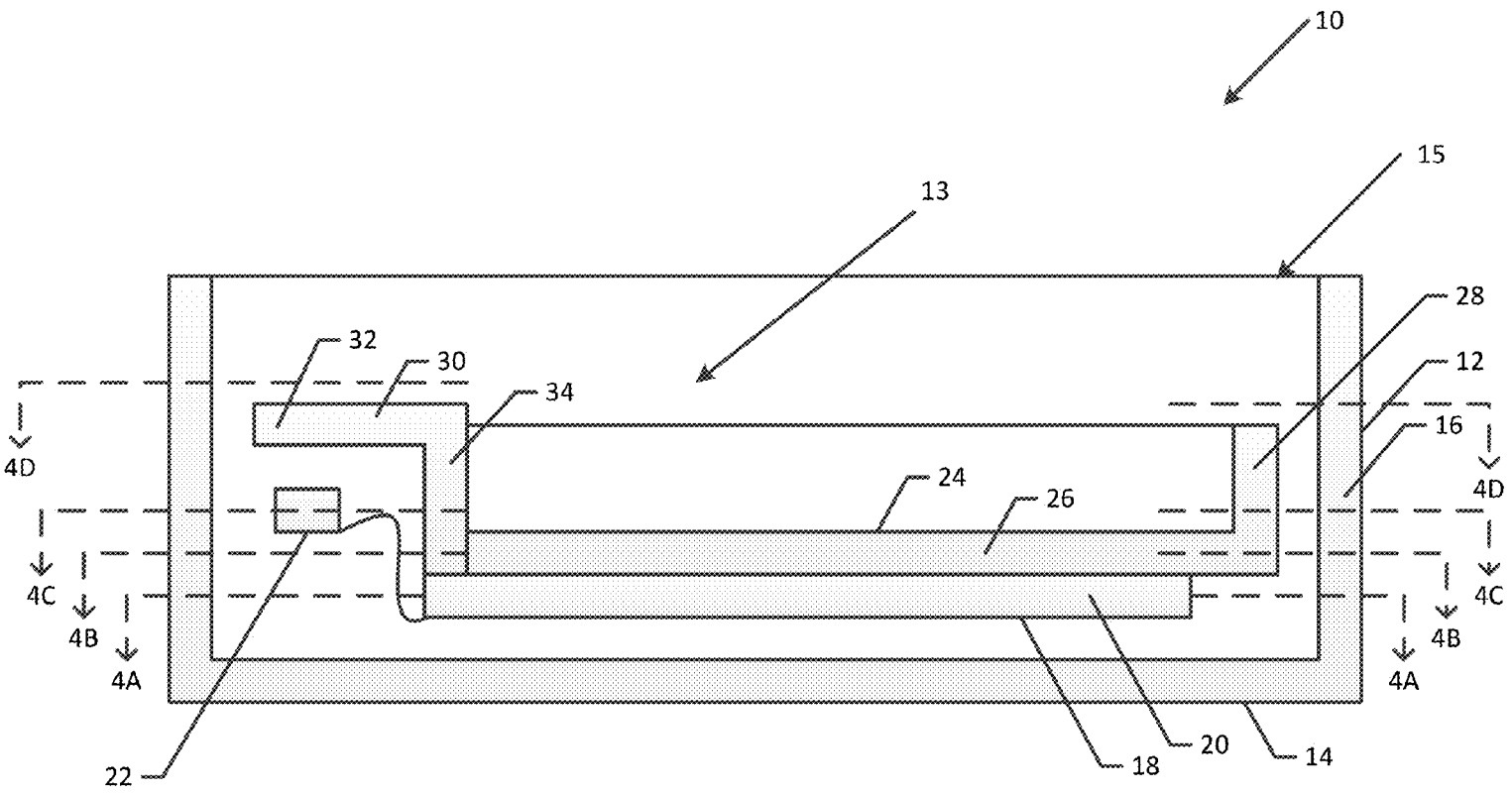
Figure 2:
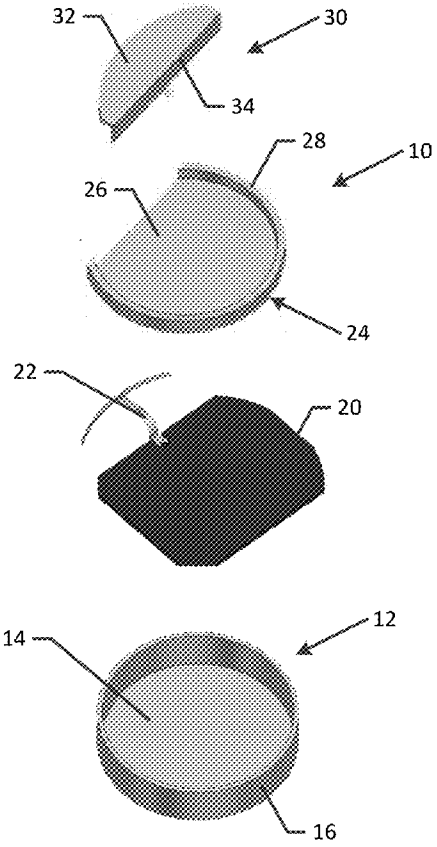
Figure 3:
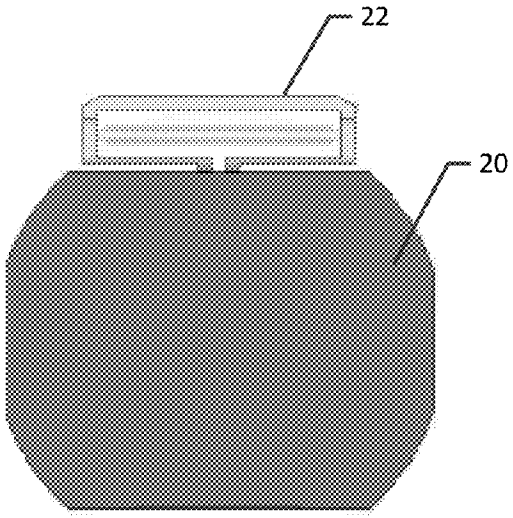
Figure 5:
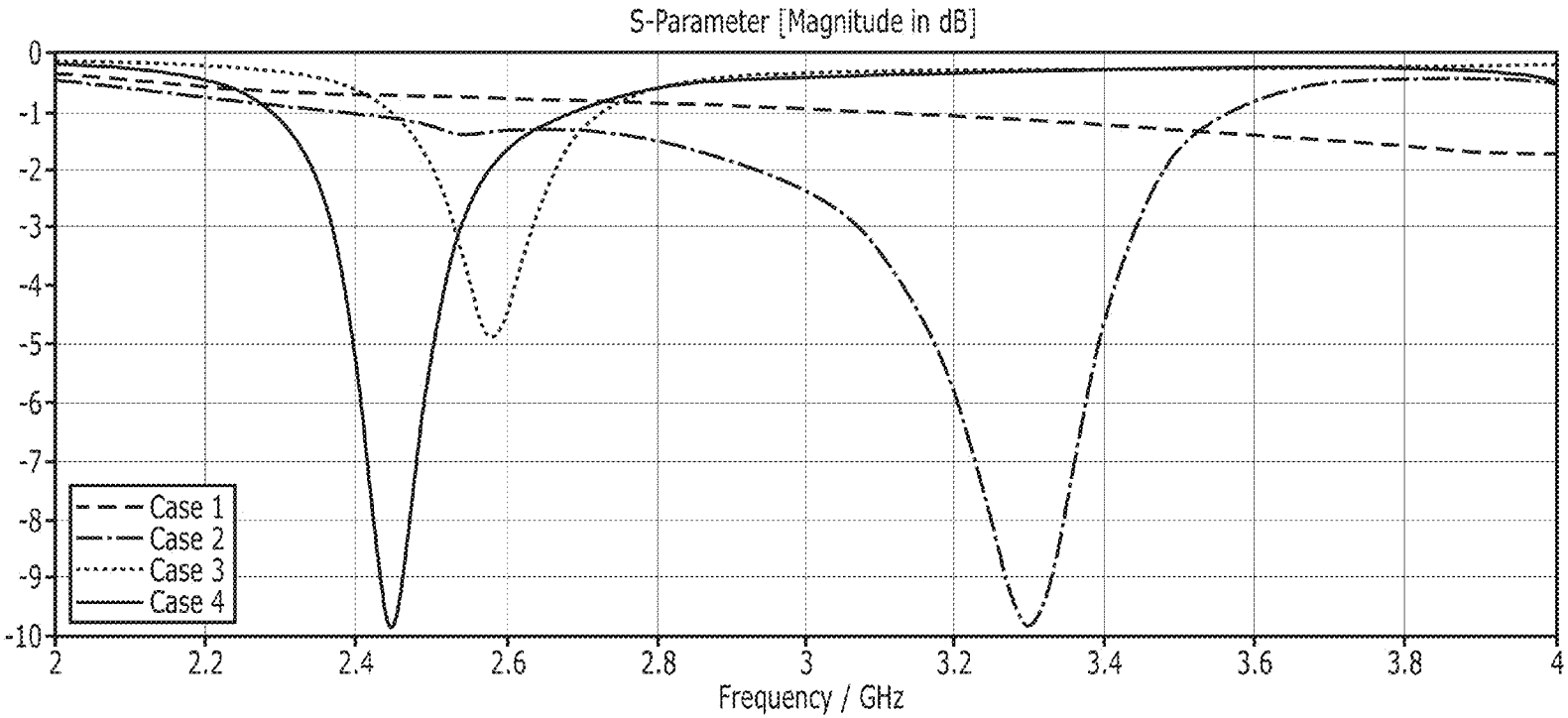
Figure 6:
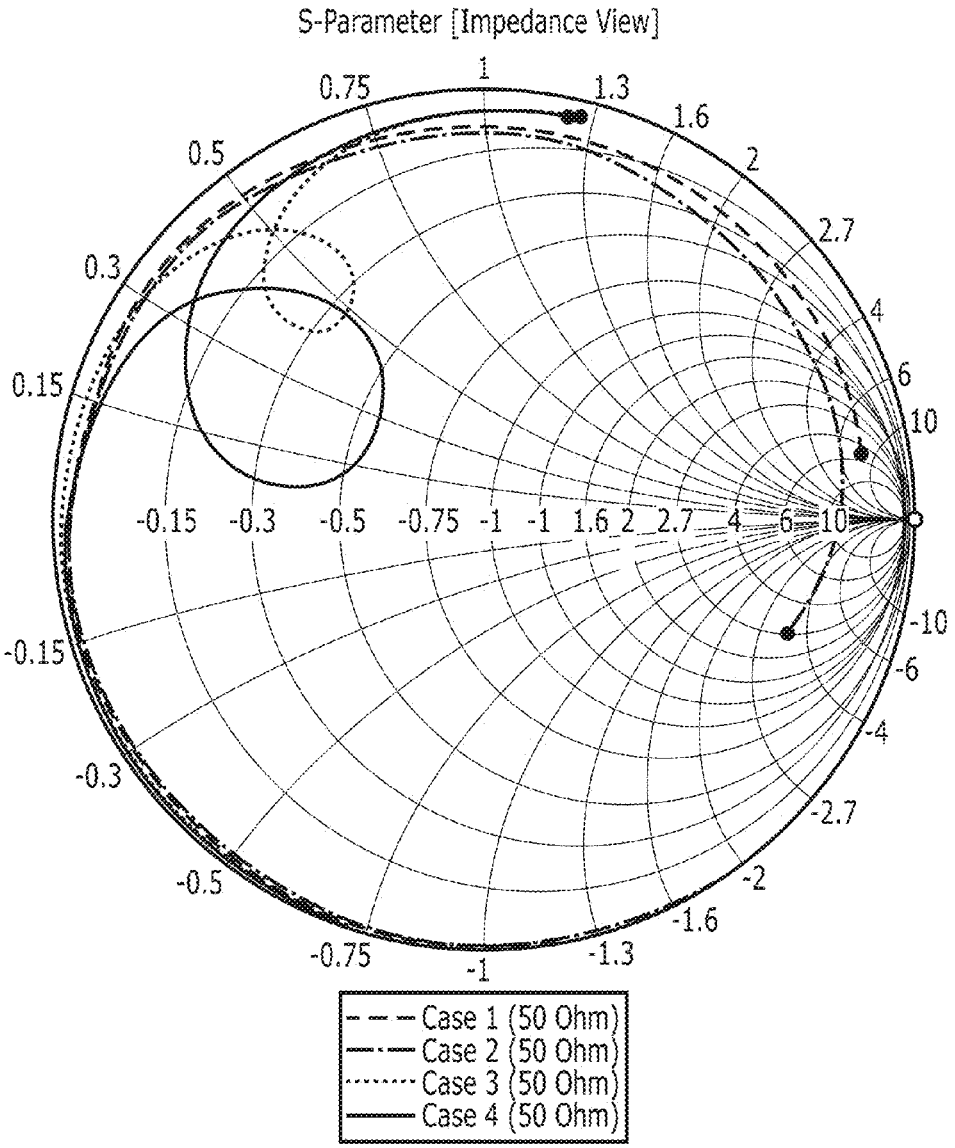
Figure 7:
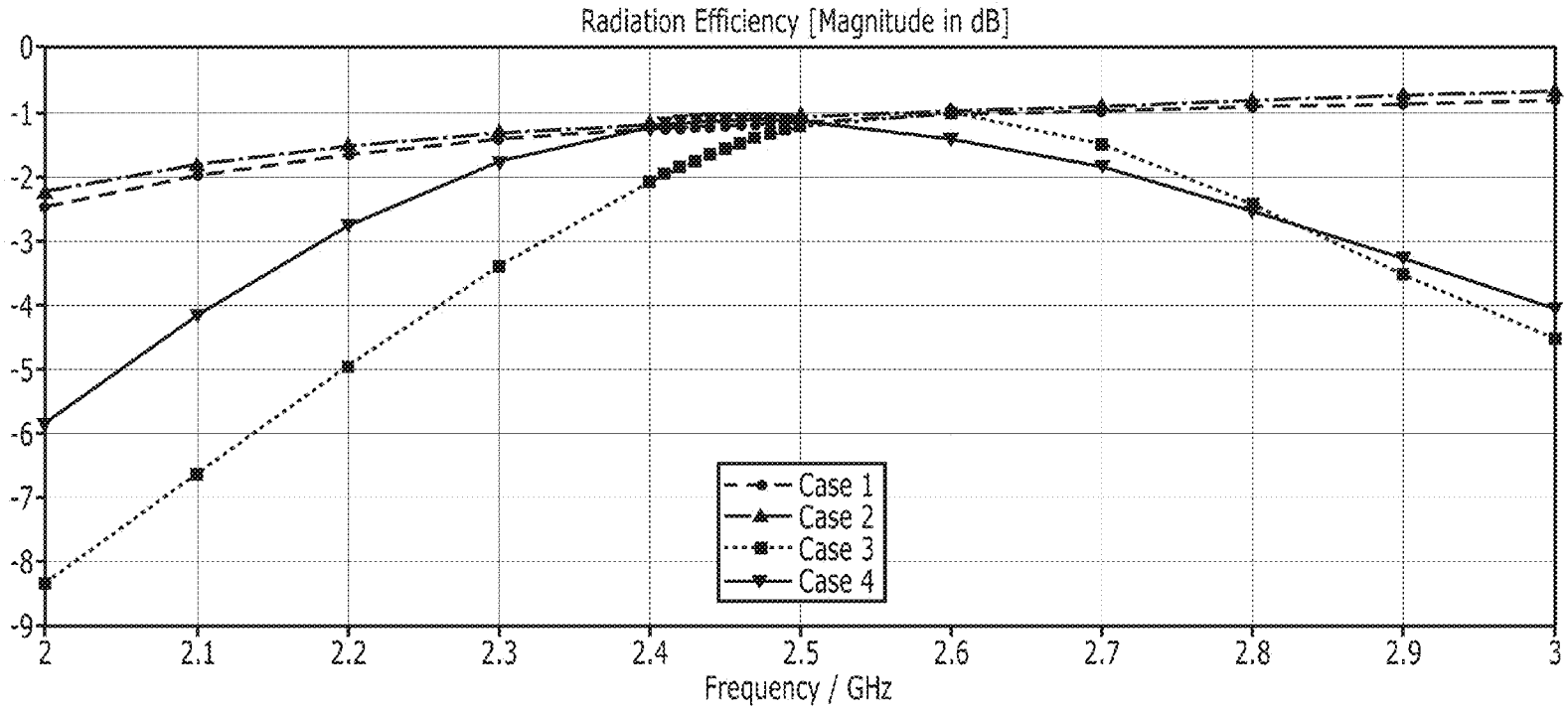
Figure 8:
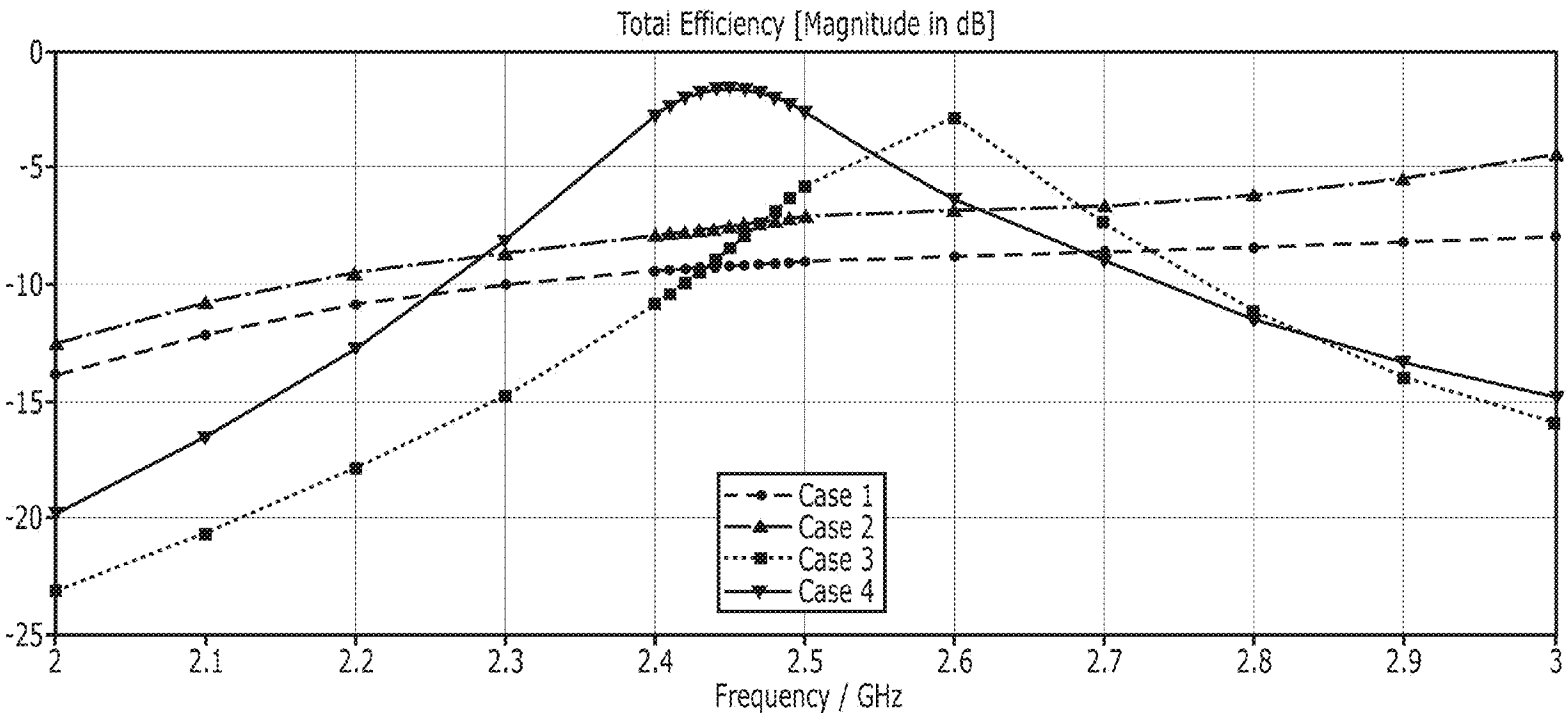

Having thus described certain example embodiments of the present disclosure in general terms, reference will hereinafter be made to the accompanying drawings, which are not necessarily drawn to scale, and wherein:

FIG. 1 is a cross-sectional view of a wireless portable electronic device in accordance with an example embodiment of the present invention;

FIG. 2 is an exploded perspective view of certain components of the wireless portable electronic device of FIG. 1 in accordance with an example embodiment of the present invention;

FIG. 3 illustrates a ground plane and an excitation antenna in the form of a loop antenna that may alternatively be utilized by a wireless portable electronic device of an example embodiment of the present invention;

FIGS. 4A-4D illustrate views of the wireless portable electronic device taken along lines 4A-4A, 4B-4B, 4C-4C and 4D-4D, respectively, of FIG. 1;

FIG. 5 graphically represents the S-parameter responses (S11—Return Loss, dB) over a range of frequencies in free space for a wireless portable electronic device including different combinations of components in accordance with an example embodiment of the present invention;

FIG. 6 is a Smith chart illustrating the S-parameter responses (S11—Complex Impedance, Ohms) over a range of frequencies from 0 to 3 GHz in free space for a wireless portable electronic device having different combinations of components in accordance with an example embodiment of the present invention;

FIG. 7 graphically represents the radiation efficiency responses (dB) over a range of frequencies in free space for a wireless portable electronic device including different combinations of components in accordance with an example embodiment of the present invention; and FIG. 8 graphically represents the total efficiency responses (dB) over a range of frequencies in free space for a wireless portable electronic device including different combinations of components in accordance with an example embodiment of the present invention.

DETAILED DESCRIPTION

Some embodiments of the present invention will now be described more fully hereinafter with reference to the accompanying drawings, in which some, but not all, embodiments of the invention are shown. Indeed, various embodiments of the invention may be embodied in many different forms and should not be construed as limited to the embodiments set forth herein; rather, these embodiments are provided so that this disclosure will satisfy applicable legal requirements. Like reference numerals refer to like elements throughout. As used herein, the terms "data," "content," "information," and similar terms may be used interchangeably to refer to data capable of being transmitted, received and/or stored in accordance with embodiments of the present invention. Thus, use of any such terms should not be taken to limit the spirit and scope of embodiments of the present invention.

A wireless portable electronic device 10 is provided in accordance with an example embodiment that includes a body 12, such as a housing, a cover, a cover portion or the like, formed of a conductive material, such as a metal material, e.g., stainless steel. In some embodiments, the body may be manufactured from a non-conductive material, e.g. molded plastic, and have one or more portions that are made conductive by metallization techniques, e.g. MID (molded interconnect device), heat staked metal on plastic, two shot molding, sputtering, conductive inks, three dimensional (3D) printing, electroplating, adhesive backed conductive sheets adhered to a non-conductive support, etc. In this regard, other components, e.g., internal components, of the wireless portable electronic device that are described below to be conductive may alternatively be formed of a non-conductive material that is manufactured so as to include one or more portions that are made conductive by metallization techniques. The wireless portable electronic device also includes one or more antennas 22 disposed within the conductive body and configured to support communications between the portable electronic device and other devices, networks or the like. Although the antenna described herein may be configured to support various types of communications including long distance communication techniques and protocols such as cellular communication techniques, the antenna of an example embodiment is configured to support short distance communications, such as Bluetooth™ communications or other proximity based communication techniques. As described below, the wireless portable electronic device is configured such that the conductive housing supports the communications, such as by serving as a radiator. As a result, the wireless portable electronic device may include a conductive body, such as a conductive housing, which may be desirable for various purposes including for aesthetic purposes, while still supporting communications with an antenna disposed within the conductive body.

The wireless portable electronic device 10 may be embodied as a variety of different types of devices including wearable devices that may be worn by or strapped to a portion of a user's body, such as a watch, a personal fitness device, a music player, a medical device, an audio/visual (AV) device, a navigation device, a wearable device having a combination of functions such as, and not limited to, radio communications, audio, video, navigation, watch, medical/body sensors, or the like. However, the wireless portable electronic device may also be embodied as a variety of other types of mobile terminals including, for example, a personal digital assistant (PDA), mobile telephone, smart phone, companion device, pager, mobile television, gaming device, laptop computer, camera, tablet computer, portable computer, touch surface, video recorder, audio/video player, radio, electronic book, navigation device or any combination of the aforementioned, and other types of voice and text communications systems.

Regardless of the manner in which the wireless portable electronic device 10 is embodied, the portable electronic device of an example embodiment is depicted in cross-section in FIG. 1. As shown, the wireless portable electronic device includes a body 12, such as a housing, formed of a conductive material, such as a metal material, e.g., stainless steel. In the example embodiment, the conductive body has a cylindrical shape with a circular floor 14 and a cylindrical wall 16 extending outwardly from the floor. As such, the wireless portable electronic device of this example embodiment may have a form factor suitable for a watch. However, wireless portable electronic devices and, more particularly, the conductive body of such portable electronic devices may have other shapes and sizes depending upon the type of portable electronic device that is to be constructed.

The conductive body 12 defines an internal cavity 13 and at least one opening 15 from the internal cavity, such as an opening through a major surface of the body. In the example embodiment of FIG. 1, the conductive body defines an open top to the cylindrical conductive body. Although not shown in FIG. 1, the conductive body may define one or more additional openings in other embodiments. For example, in an embodiment in which the wireless portable electronic device is embodied as a watch, the conductive body may include or otherwise be associated with a hinge, such as a pair of hinges, for the attachment of a strap or band to the conductive body to secure the watch to the user's wrist. In this example embodiment, the conductive body may define additional openings, such as in the form of slits, proximate to the hinges. The slits, such as in an embodiment in which the slits are positioned underneath the antenna, can be used to further improve the antenna performance as the slits increase the relative distance from the excitation element to the near-by conductive elements. Thus, the slits, such as those positioned underneath the antenna, can be utilized to reduce the overall product size.

Although the top of the conductive body 12 of the embodiment of FIG. 1 is shown to be open, the opening defined by the conductive body is generally covered by another component of the wireless portable electronic device 10, such that the body of an example embodiment is water and/or dust resistant. The other component is not generally comprised, at least not completely, of a conductive material such that the opening remains open in terms of not being covered with a conductive material. For example, in an embodiment in which the wireless portable electronic device is embodied as a watch, the open top of the cylindrical conductive body of FIG. 1 may be covered with a touch screen display, a keypad or the like to facilitate user interaction with the portable electronic device. The touch screen display or other component that covers the opening defined by the conductive body is not depicted in FIG. 1 as only those components associated with the antenna 22 for supporting communication by the wireless portable electronic device are depicted with a number of other components that provide other functions are omitted for purposes of clarity.

As shown in FIG. 1, the wireless portable electronic device 10 includes a plurality of components disposed within the internal cavity defined by the conductive body 12 and coupled together as described below in order to support communication by the wireless portable electronic device. As used herein, the coupling of components refers to either a galvanic connection or an electromagnetic connection (capacitive and/or inductive coupling). In this regard, the portable electronic device includes a ground plane 18 disposed within the internal cavity and electromagnetically coupled to the body 12 as well as an antenna 22 disposed within the internal cavity and electromagnetically coupled to the body and, in an example embodiment, to both the ground plane and to the body. In this regard, in an embodiment in which the antenna is a monopole, only a feed between the antenna and the RF circuitry may be needed with no connection between the antenna and ground plane being required. However, if the antenna is of a different type, such as a planar inverted-F antenna (PIFA), at least one coupling to the ground plane may also be required. Since the ground plane may be electromagnetically coupled to both the antenna and the body, the ground plane may have any of various shapes. Although the ground plane may be configured in various manners, the ground plane of an example embodiment is provided by a printed wiring board 20. The printed wiring board includes a plurality of electrical components for performing the various functions of the wireless portable electronic device carried by a substrate formed of an insulating material. In addition, the printed wiring board of this example embodiment includes the ground plane, such as may be provided on an opposite surface of the printed wiring board, such as an opposite surface of the insulating substrate, from the surface of the printed wiring board that carries the plurality of electrical components. The printed wiring board and the ground plane may be disposed in either a symmetrical fashion within the body or in an asymmetrical fashion and the ground plane and the printed wiring board may have various sizes and shapes without adversely impacting the antenna efficiency of the wireless portable electronic device.

As shown in FIG. 1, the ground plane 18 of an example embodiment is spaced from the body 12, such as the floor 14 of the body. The ground plane may be spaced by different distances, such as about 2 mm in an example embodiment. The antenna efficiency of the wireless portable electronic device 10 of some embodiments may be degraded if the ground plane is too close to the floor, such as with a spacing of 1 mm or less. In an embodiment in which the conductive body defines additional openings, such as slits underneath the antenna, the openings can further improve the antenna performance as the openings increase the relative distance from the excitation element to the near-by conductive elements. Dependent on the operational frequency of the antenna, the slit(s) may also add one or more "slot" resonances to the antenna and in some circumstances may widen the bandwidth of the natural bandwidth produced by the antenna alone. In this scenario, the slit(s) become a parasitic resonator which is closely coupled to the antenna so as to widen the overall bandwidth produced by the combination of the fed antenna and the parasitic slit.

In the illustrated embodiment, the antenna 22 is mechanically supported by the printed wiring board 20 and extends outwardly from the printed wiring board, such as in a cantilevered manner. As shown in the embodiment of FIG. 1, for example, the antenna extends outwardly from the printed wiring board, such as in an outwardly and upwardly direction. As such, the antenna may be positioned further from the floor 14 of the conductive body 12 than the printed wiring board and the ground plane 18 carried thereby. In embodiments in which the wireless portable electronic device 10 is configured to be worn by a user, such as a watch, for example, the spacing of the antenna from the floor of the conductive body advantageously spaces the primary location of transmission and reception of RF signals from the user, such as from the user's wrist. The antenna may be configured in different manners. As shown in the exploded perspective view of FIG. 2, for example, the antenna may be a monopole, such as a top loaded monopole. Alternatively, the antenna may be embodied by a loop antenna, such as a single loop antenna, such as shown in FIG. 3. In either embodiment, the antenna extends outwardly from the printed wiring board so as to be positioned proximate to the conductive body, such as the wall 16 of the conductive body, while remaining spaced therefrom.

The wireless portable electronic device 10 also includes radio frequency (RF) circuitry coupled to a conductive feed element of the antenna 22 with any of various types of RF coupling means, such as a printed transmission line, a coaxial cable, a metal strip or the like. As such, RF signals may be transmitted by the RF circuitry to the antenna for transmission therefrom and RF signals received by the antenna may be, in turn, received by the RF circuitry. Although the RF circuitry may be embodied in various manners, the RF circuitry of an example embodiment is also provided by the printed wiring board 20. In some embodiments, the ground plane 18, such as may be carried by the printed wiring board, may also be galvanically coupled to the body 12, such as via an RF filter, e.g., a coil ranging from 5 nH to 56 nH or a tank filter consisting of a coil (about 6 nH) and a capacitor (about 2 pF), in order to account for electrostatic discharge.

As shown in FIG. 1, the wireless portable electronic device 10 also includes a three-dimensional ground plane extension 30. The three-dimensional ground plane extension may be formed of a conductive material, such as stainless steel. The three-dimensional ground plane extension is also disposed within the internal cavity defined by the conductive body 12 and is positioned in such a manner that at least a part of the three-dimensional ground plane extension overlies the antenna 22. Thus, the three-dimensional ground plane extension is positioned between the antenna and the opening defined by the body. The three-dimensional ground plane extension is galvanically coupled to the ground plane 18 and is also electromagnetically coupled to the body. In an example embodiment, the three-dimensional ground plane extension is configured to be RF floating. In this regard and as noted above with respect to the ground plane 18, the three-dimensional ground plane extension may also be galvanically coupled to the body, such as via an RF filter, which, as a non-limiting example, may include an inductor, in order to account for electrostatic discharge.

As shown in more detail in the exploded perspective view of FIG. 2, the three-dimensional ground plane extension 30 includes a first portion 32, such as a semicircular planar portion, that is positioned so as to overlie the antenna 22. The first portion of the three-dimensional ground plane extension may be spaced from the antenna by various amounts with the distance between antenna and ground plane extension being adjusted so as to provide capacitive coupling without impacting antenna radiation efficiency. In this regard, the size(s), e.g., the length(s), width(s) and/or thickness(es), the relative location and the inter-spacing of all the components which comprise the overall radiator, including the ground plane, define the desired resonant frequency(ies), bandwidth(s) and radiated efficiency(ies). In an example embodiment, the first portion of the three-dimensional ground plane extension is spaced from the antenna by $\lambda/50$ with $\lambda$ being 125 mm in free-space at 2.4 GHz.

The three-dimensional ground plane extension 30 of this example embodiment also includes a second portion 34 that extends from the first portion 32 towards the ground plane 18, such as to a distal edge that is in contact with the printed wiring board 20. The second portion of the three-dimensional ground plane extension is therefore interior of the antenna 22 such that the antenna is positioned between the second portion of the three-dimensional ground plane extension and the body 12. As a result of the orientation of the second portion of the three-dimensional ground plane extension, such as in a Z-direction extending orthogonally from the ground plane, the second portion of the three-dimensional ground plane extension provides for more accurate coupling to the body, such as the wall 16 of the body, since there is improved control of the capacitive coupling and range of capacitive reactances. As such, the range of possible impedances used to match the ground plane to the body may be improved. From a mechanical design standpoint, the first portion 32 of the three-dimensional ground plane extension may be designed such that the mechanical dimensional tolerances are reduced or minimized so that accurate control over the capacitance created between the first portion 32 and the wall 16 of the body can be obtained. This control over the capacitance created between the first portion 32 and the wall of the body facilitates batch-to-batch control during the high volume manufacture of such parts. The reduction or minimization of mechanical dimensional tolerances may be attained by the selection of specific materials to be used, such as based on their inherent tolerance which is due to their production technique and/or their natural material tolerance. For example, some materials (which have a lower dimensional tolerance) do not change dimensions to a great degree as temperature increases, but other materials (which have a greater dimensional tolerance) do. Additionally, the physical arrangement of the components affords the designer more freedom to take into account the manufacturing and material characteristics in the design of the capacitive coupler. Although the first and second portions of the three-dimensional ground plane extension may be configured in various manners, the first and second portions of the three-dimensional ground plane extension of an example embodiment are perpendicular to one another so as to define an L-shape in cross-section with the second portion extending from an edge of the first portion towards the ground plane.

In an example embodiment, the three-dimensional ground plane extension 30 and, in particular, the first portion 32 of the three-dimensional ground plane extension may be configured to serve as a mechanical support structure for another component of the wireless portable electronic device 10. As such, other components, such as components unrelated to the transmission and reception of RF signals by the antenna 22, may be mechanically supported by the first portion of the three-dimensional ground plane extension. In this regard, the various other components that may be mechanically supported by the first portion of the three-dimensional ground plane extension include, for example, a circuit board, a clock mechanism, a loud speaker, a display, an input device, such as a keyboard or touchscreen, a connector socket, a switch or the like.

As a result of the electromagnetic coupling of both the antenna 22 and the ground plane 18 and the three-dimensional ground plane extension 30 with the conductive body 12 of the wireless portable electronic device 10, the conductive body does not destructively interfere with the signals transmitted and received by the antenna. Instead, the electromagnetic coupling of the antenna and the ground plane and the three-dimensional ground plane extension with the conductive body causes the conductive body to serve as a radiator, such as with a readily matched 50 Ohm input impedance response in an example embodiment. In this regard, the antenna does not directly couple with the opening defined by the body, but interacts with the body, such as via an electric field coupling that is orthogonal to the opening, at an electromagnetic coupling point that may be spaced from the opening in order to mimic lambda slot in order to provide desirable radiation efficiency at frequencies of interest. Thus, the signals transmitted by the antenna are radiated by the conductive body of the wireless portable electronic device so as to support communications by the portable electronic device, such as with other devices. Similarly, signals received by the wireless portable electronic device may be radiated from the conductive body to the antenna in order to improve the communication performance characteristics of the antenna.

In order to further improve the performance characteristics associated with the antenna 22 of the wireless portable electronic device 10 of an example embodiment, the portable electronic device may also include a conductive member 24 disposed within the internal cavity and galvanically coupled to both the ground plane 18 and the three-dimensional ground plane extension 30 with the electromagnetic coupling being controlled by the extension of the three-dimensional ground plane extension 30 over the antenna. Although the three-dimensional ground plane extension may be a separate component relative to the floor portion 26 and the edge portion 28 of the conductive member, the conductive member of an example embodiment may be integral with the three-dimensional ground plane extension such that the three-dimensional ground plane extension, the floor portion and the edge portion of the conducive member may be produced as a single component. The conductive member may provide a capacitive reactance response due to the near field capacitive electromagnetic coupling to the walls 16 of the body 12. The conductive member may be formed of a metal, such as stainless steel. As shown in FIG. 1 and, in more detail, in the exploded perspective view of FIG. 2, the conductive member of an example embodiment is positioned between the ground plane, such as between the printed wiring board 20, and the opening defined by the body. In this regard, conductive member of an example embodiment may be proximate to, such as by being immediately adjacent to the printed wiring board that carries the ground plane such that the conductive member overlies the printed wiring board including the ground plane and is galvanically coupled thereto. Alternatively, the ground plane may be positioned between the conductive member, such as the printed wiring board, and the opening defined by the body. As noted above, the conductive member is also galvanically coupled to the three-dimensional ground plane extension, such as by contacting the three-dimensional ground plane extension at a distal edge thereof as shown in FIG. 1.

Although the conductive member 24 may be constructed to have various shapes and sizes and, as such, may be either symmetric or asymmetric, the conductive member of an example embodiment includes a floor portion 26 and an edge portion 28 extending outwardly, such as upwardly, from the floor portion in a direction away from the ground plane 18. In this regard, the edge portion may extend outwardly from an edge of the floor portion. As shown in FIG. 2, the edge portion does not extend about the entire circumference of the floor portion, but instead extends outwardly from a majority of the edge of the floor portion. The edge portion of the conductive member may extend outwardly from the floor portion by any of various distances. Although not required for proper functioning of the antenna, the edge portion of the conductive member of an example embodiment may extend outwardly from the floor portion such that the distal end of the edge portion is aligned with the first portion 32 of the three-dimensional ground plane extension 30. In other words, the top of the edge portion of the conductive member is aligned with the first portion of the three-dimensional ground plane extension in the embodiment of FIG. 1. The edge portion 28 may also contribute to the capacitive coupling between the ground plane, such as the printed wiring board, and the side wall 16 of the body. The amount of coupling can be controlled by designing the height (and/or the thickness or other structural properties) of the edge portion accordingly and the distance relative to the wall 16. The edge portion 28 may in some embodiments be different heights along its length dependent on the capacitive coupling effect that is desired. In this regard, the control of the capacitive coupling at any point along the perimeter of the conductive member 24 that is afforded by designing the edge portion 28 accordingly may be advantageous in some embodiments.

Figure 4A:
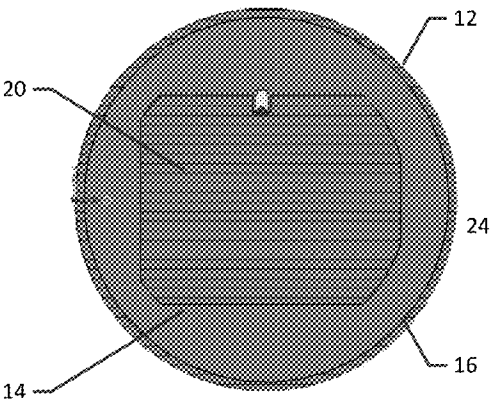
Figure 4B:
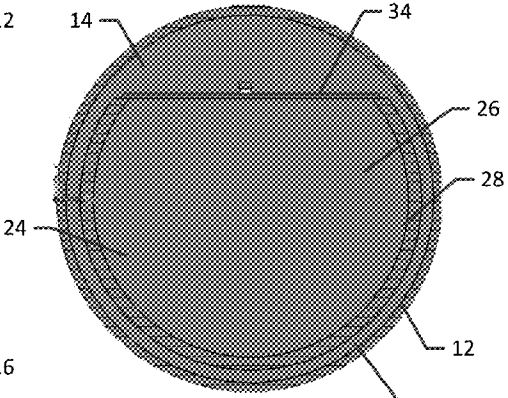
Figure 4C:
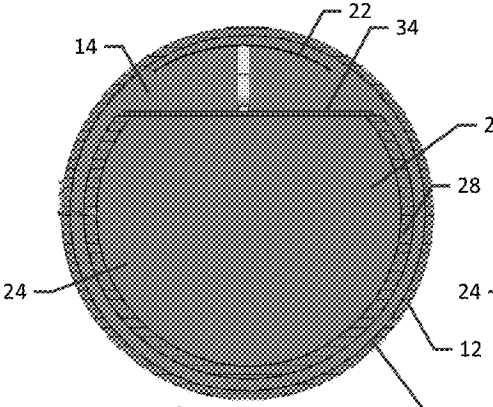
Figure 4D:
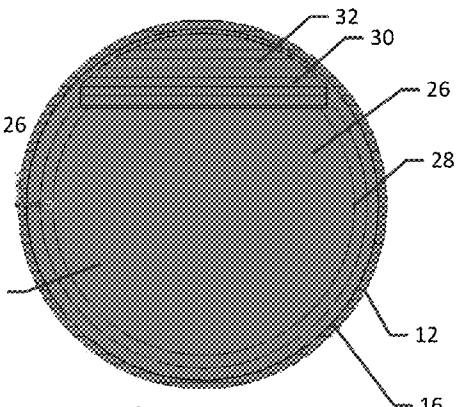

FIGS. 4A-4D further illustrate the foregoing components of a wireless portable electronic device 10 in accordance with an example embodiment. In this regard, FIG. 4A taken along line 4A-4A of FIG. 1 depicts the printed circuit board 20, which carries the ground plane 18, disposed with the conductive body 12. FIG. 4B taken along line 4B-4B of FIG. 1 depicts the conductive member 24 placed upon the printed circuit board, while FIG. 4C taken along line 4C-4C of FIG. 1 again depicts the conductive member placed upon the printed circuit board but is taken along a plane that also illustrates the antenna 22 that extends outwardly from the printed circuit board. Further, FIG. 4D taken along line 4D-4D of FIG. 1 depicts the three-dimensional ground plane extension 30 positioned so that at least a part of the three-dimensional ground plane extension overlies the antenna.

The internal cavity defined by the conductive body 12 of the wireless portable electronic device 10 may also include a number of other components for performing the other functions of the portable electronic device 10. These other components have not been depicted in the figures, however, for purposes of clarity. In addition, the remainder of the internal cavity defined by the conductive body of the wireless portable electronic device may be filled with air or another filler, for example, and not limited to a dielectric material (non-conductive) such as plastic. The wireless portable electronic device may also include various mechanical components, such as components formed of plastic or other non-conductive material, to secure the components depicted in the embodiment of FIG. 1, such as the printed wiring board 18, the conductive member 24 and the three-dimensional ground plane extension 30 in their relative positions with respect to the conductive body of the wireless portable electronic device. These mechanical components have also not been depicted in the figures to ensure that the components that contribute to communications via the antenna 22 are clearly shown.

The performance of an example embodiment of a wireless portable electronic device 10 including the printed wiring board 20 that includes a ground plane 18 and supports an antenna 22 (but without a conductive member 24 and a three-dimensional ground plane extension 30) is depicted as Case 1 in FIGS. 5-8 in comparison to other configurations of the wireless portable electronic device. In regards to the graphical representations of FIGS. 5-8, the wireless portable electronic device of Case 2 includes the printed wiring board that includes a ground plane and supports an antenna as well as the conductive member (but without a three-dimensional ground plane extension), while the wireless portable electronic device of Case 3 includes the printed wiring board that includes a ground plane and supports an antenna as well as a three-dimensional ground plane extension (but without a conductive member) and the wireless portable electronic device of Case 4 includes the printed wiring board that includes a ground plane and supports an antenna as well as the both conductive member and a three-dimensional ground plane extension.

As shown in FIG. 5, the S-parameter (S11—Return Loss, dB) in free space is relatively flat, albeit with a slight declination, over a range of frequencies from 2 GHz to 4 GHz for Case 1 in which the wireless portable electronic device 10 only includes the printed wiring board 20 that includes the ground plane 18 and that carries the antenna 22. However, in Cases 2, 3 and 4 that include the conductive member 24, the three-dimensional ground plane extension 30 and both the conductive member and the three-dimensional ground plane extension, respectively, the S-parameter varies significantly with the S-parameter having an extremely small magnitude for certain resonant frequency, such as about 3.3 GHz for Case 2, about 2.55 GHz for Case 3 and about 2.45 GHz for Case 4. As used herein, free space refers to the condition that the volume surrounding the device consists of only free-space relative permittivity and permeability medium. Similarly, another comparison of S-parameters for Cases 1, 2, 3 and 4 as defined above is provided by the Smith chart (S11—Complex Impedance, Ohms) of FIG. 6 over a frequency range of 0 GHz (as represented by the end of the curves having an open circle) to 3 GHz in free space (as represented by the end of the curves having a solid circle).

FIG. 7 depicts the radiation efficiency (dB) in free space over a range of frequencies from 2 GHz to 3 GHz for Cases 1, 2, 3 and 4 as defined above. As shown, the radiation efficiency over the frequency range for a wireless portable electronic device 10 is relatively flat and almost linear for Case 1 but is peaked for Cases 3 and 4 at or about the resonant frequency for the respective configurations. The radiation efficiency of Case 2 generally follows the radiation efficiency of Case 1 over the frequency range of 2 GHz to 3 GHz, but would have a similar peak to those exhibited by Cases 3 and 4 centered about 3.3 GHz as a result of the resonant frequency for Case 2. Further, FIG. 8 correspondingly depicts the total efficiency (dB) in free space over the same range of frequencies, that is, from 2 GHz to 3 GHz, for each of the four cases. Relative to the total efficiency of Case 1 that varies only slightly across the frequency range, the total efficiency associated with Cases 3 and 4 are again peaked at their respective resonant frequencies and the total efficiency of Case 2, while varying relatively little across the frequency range of 2 GHz and 3 GHz would be similarly peaked about its resonant frequency of about 3.3 GHz.

Although FIGS. 5-8 illustrate the performance of certain example embodiments of the wireless portable electronic device 10, the portable electronic device may be configured to provide different performance, such as different resonant frequencies in other embodiments. For example, the electric field coupling between the antenna 22 and the body 12 at least partially defines the resonance response. As such, the electric field coupling may be modified and correspondingly the resonance response including the resonant frequencies may be modified up to 100 MHz. In another embodiment, the antenna 22 may be multi-resonant so as to produce more than one distinct operational frequency band. In addition, the device 10 can utilize traditional impedance matching techniques at the feed of the antenna to further tune and/or fine-tune the resonant frequency.

As such, the wireless portable electronic device 10 of an example embodiment offers improved communication performance by electromagnetically coupling the antenna 22, the ground plane 18 and the three-dimensional ground plane extension 30 with the conductive body 12 such that the conductive body serves as a radiator. Thus, the wireless portable electronic device of an example embodiment offers both the advantages of having a conductive body, such as a metallic body, for aesthetic and other reasons, as well as providing desirable communications performance. Moreover, the wireless portable electronic device permits the advantageous combination of a conductive body and desirable communication performance in instances in which the form factor of the portable electronic device is reduced, such as for watches or other relatively small portable electronic devices.

Many modifications and other embodiments of the inventions set forth herein will come to mind to one skilled in the art to which these inventions pertain having the benefit of the teachings presented in the foregoing descriptions and the associated drawings. Therefore, it is to be understood that the inventions are not to be limited to the specific embodiments disclosed and that modifications and other embodiments are intended to be included within the scope of the appended claims. Moreover, although the foregoing descriptions and the associated drawings describe example embodiments in the context of certain example combinations of elements and/or functions, it should be appreciated that different combinations of elements and/or functions may be provided by alternative embodiments without departing from the scope of the appended claims. In this regard, for example, different combinations of elements and/or functions than those explicitly described above are also contemplated as may be set forth in some of the appended claims. Although specific terms are employed herein, they are used in a generic and descriptive sense only and not for purposes of limitation.

That which is claimed:

1. An apparatus comprising:

a body comprised of a conductive material, wherein the body defines an internal cavity and an opening;

a ground plane disposed within the internal cavity and electromagnetically coupled to the body;

an antenna disposed within the internal cavity and electromagnetically coupled to the body such that the body functions as a radiator; and a three-dimensional ground plane extension disposed within the internal cavity so that at least a part of the three-dimensional ground plane extension overlies the antenna, wherein the three-dimensional ground plane extension is galvanically coupled to the ground plane and electromagnetically coupled to the body.

2. An apparatus according to claim 1 wherein the three-dimensional ground plane extension comprises a first portion that overlies the antenna and a second portion that extends from the first portion toward the ground plane.

3. An apparatus according to claim 1 wherein the three-dimensional ground plane extension is positioned between the antenna and the opening defined by the body.

4. An apparatus according to claim 1 further comprising a conductive member disposed within the internal cavity and galvanically coupled to both the ground plane and the three-dimensional ground plane extension.

5. An apparatus according to claim 4 wherein the conductive member is positioned between the ground plane and the opening defined by the body.

6. An apparatus according to claim 4 wherein the conductive member comprises a floor portion and an edge portion extending outwardly from the floor portion in a direction away from the ground plane.

7. A wireless portable electronic device comprising the apparatus of claim 1.

8. An apparatus comprising:

a body comprised of a conductive material, wherein the body defines an internal cavity and an opening;

a ground plane disposed within the internal cavity;

an antenna disposed within the internal cavity and electromagnetically coupled to the body such that the body functions as a radiator; and a three-dimensional ground plane extension disposed within the internal cavity so that at least a part of the three-dimensional ground plane extension overlies the excitation antenna, wherein the three-dimensional ground plane extension comprises a first portion that overlies the antenna and a second portion that extends from the first portion toward the ground plane, and wherein the first portion of the three-dimensional ground plane extension is configured to serve as a mechanical support structure for another component of the apparatus.

9. An apparatus according to claim 8 wherein the three-dimensional ground plane extension is positioned between the antenna and the opening defined by the body.

10. An apparatus according to claim 8 further comprising a conductive member disposed within the internal cavity and galvanically coupled to both the ground plane and the three-dimensional ground plane extension.

11. An apparatus according to claim 10 wherein the conductive member is positioned between the ground plane and the opening defined by the body.

12. A device apparatus according to claim 10 wherein the conductive member comprises a floor portion and an edge portion extending outwardly from the floor portion in a direction away from the ground plane.

13. A wireless portable electronic device comprising the apparatus of claim 8.

14. An apparatus comprising:

a body comprised of a conductive material, wherein the body defines an internal cavity and an opening;

a ground plane disposed within the internal cavity;

an antenna disposed within the internal cavity and electromagnetically coupled to the body such that the body functions as a radiator;

a three-dimensional ground plane extension disposed within the internal cavity so that at least a part of the three-dimensional ground plane extension overlies the antenna; and a conductive member disposed within the internal cavity and galvanically coupled to both the ground plane and the three-dimensional ground plane extension.

15. An apparatus according to claim 14 wherein the three-dimensional ground plane extension comprises a first portion that overlies the antenna and a second portion that extends from the first portion toward the ground plane.

16. An apparatus according to claim 15 wherein the three-dimensional ground plane extension is galvanically coupled to the ground plane, and wherein the first portion of the three-dimensional ground plane extension is configured to serve as a mechanical support structure for another component of the apparatus.

17. An apparatus according to claim 14 wherein the three-dimensional ground plane extension is positioned between the antenna and the opening defined by the body.

18. An apparatus according to claim 14 wherein the conductive member is positioned between the ground plane and the opening defined by the body.

19. An apparatus according to claim 14 wherein the conductive member comprises a floor portion and an edge portion extending outwardly from the floor portion in a direction away from the ground plane.

20. A wireless portable electronic device comprising the apparatus of claim 14.

* * * * *